US008584684B2

(12) United States Patent
Nakamura

(10) Patent No.: US 8,584,684 B2
(45) Date of Patent: Nov. 19, 2013

(54) NAIL CARE OR FINGER CARE TOOL AND NAIL CARE OR FINGER CARE TOOL SET

(76) Inventor: Koji Nakamura, Osaka (JP)

( * ) Notice: Subject to any disclaimer, the term of this patent is extended or adjusted under 35 U.S.C. 154(b) by 65 days.

(21) Appl. No.: 13/107,128

(22) Filed: May 13, 2011

(65) Prior Publication Data

US 2011/0284017 A1 Nov. 24, 2011

(30) Foreign Application Priority Data

May 24, 2010 (JP) ..... 2010-117976

(51) Int. Cl.
*A45D 29/18* (2006.01)
*A41D 13/08* (2006.01)

(52) U.S. Cl.
USPC ..... 132/74.5; 2/21

(58) Field of Classification Search
USPC ..... 132/74.5, 73, 285, 319; 2/21
See application file for complete search history.

(56) References Cited

U.S. PATENT DOCUMENTS 2,637,031 A * 5/1953 Friedman ..... 2/21
2,847,005 A * 8/1958 Bourne ..... 602/58
3,263,682 A * 8/1966 Rosenfield ..... 602/63
4,694,508 A * 9/1987 Iriyama et al. ..... 2/21
5,348,153 A * 9/1994 Cole ..... 206/361
6,305,383 B1 * 10/2001 Thoma ..... 132/200
6,634,367 B2 * 10/2003 Abraham et al. ..... 132/74.5
6,916,301 B1 * 7/2005 Clare ..... 602/3
6,988,502 B2 * 1/2006 Tsukamoto ..... 132/200
7,316,034 B1 * 1/2008 Berry et al. ..... 2/21
7,779,483 B2 * 8/2010 Berry et al. ..... 2/21

FOREIGN PATENT DOCUMENTS

JP 60-30711 U 3/1985
JP 6-38808 U 5/1994
JP 2005-36325 A 2/2005
JP 4363614 B2 8/2009
JP 2009-273873 A 11/2009

* cited by examiner

*Primary Examiner* — Robyn Doan

(74) *Attorney, Agent, or Firm* — Knobbe, Martens, Olson & Bear LLP

(57) ABSTRACT

A nail care or fingertip care tool is constituted by an elastic bag-like material having sufficient size to cover the nail at the fingertip and also having a liquid-absorbing member fixedly attached over an area inside the bag-like material that comes in contact with the nail.

9 Claims, 6 Drawing Sheets

NAIL CARE OR FINGER CARE TOOL AND NAIL CARE OR FINGER CARE TOOL SET

BACKGROUND OF THE INVENTION

1. Field of the Invention

The present invention relates to a nail care or finger care tool and nail care or finger care tool set used for removal of nail finish or care for nails and fingers.

2. Description of the Related Art

Gel nails have become popular in recent years as a new type of nail finish, which has been traditionally used for coloring nails, and nail finishes of soft gel type have also been often used.

This soft gel can be removed with a solution and can be applied without shaving the nail.

Soft gel uses a material having minimum burdens on the base nail, and this type of nail finish also lasts for a long period of 3 to 5 weeks. Accordingly, it is suitable for people who want to reinforce weak nails, those who suffer from peeling nails, or whose nails crack easily. Also, soft gel is easy to apply due to high viscosity and it hardens rapidly under UV light, and thus can be applied quickly.

Other favorable properties of soft gel are that it has no smell, its color lasts for a long period, and it does not peel easily because of its flexibility.

Nail polish remover, for example, is used to remove soft gel. The specific method to use this nail polish remover is as follows. First, only the surface of soft gel is filed to add small scratches to the surface of soft gel so that nail polish remover can be absorbed easily.

Next, a cotton ball, etc., moistened with soft gel nail polish remover is placed on the nail and then a piece of aluminum foil, etc., is wrapped around it to let nail polish remover penetrate into the soft gel. After 10 to 15 minutes or so, soft gel becomes soft and can be removed.

Soft gel is difficult to remove by using ethanol, and normally nail polish remover containing acetone is used and, as explained above, a cotton ball moistened with nail polish remover must remain in contact with the surface of soft gel for at least 10 minutes before soft gel can be removed. However, acetone in nail polish remover contacts the base nail or skin around the nail, causing the surface of the nail or skin to turn white or rough.

In addition, even if the nail is wrapped with aluminum foil, etc., acetone or other organic solvent contained in nail polish remover still volatilizes and a foul smell, which is more irritating than the traditional smell of ethanol, is released into the room through the gaps between the aluminum foil and finger. Furthermore, a member to secure the aluminum foil around the finger must be put on each finger, and to make nail polish remover attach to the surface of soft gel, the aluminum foil must be retained at the finger tip for the required period of 10 to 15 minutes in such a way that the fingers are kept apart from each other to prevent these securing members from contacting each other.

As described in Patent Literature 1, a technique to use an auxiliary nail polish removal tool to secure cotton balls on the surface of nails, in between fingertips, is known, for the purpose of keeping these cotton balls moistened with nail polish remover on the fingertips. If such auxiliary nail polish removal tool is used, however, the user cannot use the fingers freely while the auxiliary nail removal tool is in use as the fingertips are immobilized by the tool.

Patent Literature 2 describes a portable manicure removal cotton comprised of a sealed bag that sandwiches and secures a part of a cotton ball, etc., moistened with nail polish remover. However, this method also requires a wide bag to be put on the fingertip and thus while the bags are on the fingers, the user cannot use the fingers freely, just as when the auxiliary nail removal tool described in Patent Literature 1 is used, because the bags contact each other.

Further, Patent Literature 3 describes a bag having a shape similar to the one described in Patent Literature 2, as well as an artificial nail resin softening system comprised of the bag having a solvent absorbing body attached along the entire periphery of the bag, while Patent Literature 4 describes a manicure removal tool comprised of a cylindrical case whose inner surface is lined with a cotton or other impregnation material moistened with manicure removal agent. However, the inventions described in Patent Literatures 3 and 4 allow solvent or impregnated agent to contact, while each invention is in use, not only the nail but also the skin around the fingertip other than the nail, often stripping natural oil from the skin and making it white or rough.

Although oil or cream is applied to the nail to care for the roughened nail, it is difficult to perform any tasks that require to use fingers while waiting for the applied oil or cream to penetrate fully into the nail.

As for the practice of applying cream to care for the roughened finger, a sufficient amount of cream must be applied to ensure sufficient care, but it usually means the fingertip becomes sticky due to a large amount of cream. Among the means for caring fingers without applying cream, a glove having a fine-grain active layer formed on the inside is known, as described in Patent Literature 5.

PATENT LITERATURES

[Patent Literature 1] Japanese Patent Laid-open No. 2009-273873

[Patent Literature 2] Japanese Utility Model Laid-open No. Sho 60-30711

[Patent Literature 3] Japanese Patent Laid-open No. 4363614

[Patent Literature 4] Japanese Utility Model Laid-open No. Hei 6-38808

[Patent Literature 5] Japanese Patent Laid-open No. 2005-36325

SUMMARY OF THE INVENTION

As explained above, when an auxiliary tool is used to secure cotton moistened with nail polish remover in between fingertips to remove soft gel or other type of nail polish, the auxiliary tool is attached on the tip of the nail, while parts of the auxiliary tool also project to the sides of the finger around the nail, and accordingly the fingertips cannot be put together or used in any way to carry out functions involving fingers.

In other words, the user cannot use the fingers while removing gel nails, which can cause problems in daily life.

Also, this type of nail polish remover contains acetone to ensure quick, clean removal, but this acetone can vaporize and fill the room with the foul smell of acetone.

Furthermore, if cream is applied to care for the roughened fingers, the fingertips become sticky and it makes it difficult to perform other tasks, etc., that require the use of fingers.

The present invention solves the aforementioned problems by providing a nail care or finger care tool comprised of an elastic bag-like material made of rubber, etc., having sufficient size to cover the nail at the fingertip and also having a liquid-absorbing member fixedly attached over the area inside the bag-like material that comes in contact with the nail, wherein said nail care or finger care tool is such that it has a fingertip contact area and a roll-up part around it; it can also have the liquid-absorbing member fixedly attached over the inner surface that spreads out when the tool is rolled back, can have the name of the nail on which the tool is placed or the position where the tool is placed indicated, or can use a film to attach the liquid-absorbing member to the area inside the bag-like material that comes in contact with the nail, or the present invention may be a nail polish remover set combining nail care or finger care tools having liquid-absorbing members of different sizes to match the nail sizes of different fingers.

When removing nail finish using a nail care or finger care tool conforming to the present invention, the rubber bag-like material comes in close contact with the fingertip to allow the liquid-absorbing member of the nail care or finger care tool impregnated with nail polish remover to properly and evenly contact the nail finish by minimizing the areas other than the nail that come in contact with nail polish remover. Accordingly, the present invention demonstrates the effects described below.

The nail finish on the surface of a nail is softened and removed without fail, while other than the nail the surface areas of skin that come in contact with nail polish remover are minimized, and this prevents natural oil from being stripped from the skin and also prevents whitening of the skin.

In addition, nail polish remover does not come in contact with outside air while nail finish is removed, which prevents vaporization and diffusion of nail polish remover into the room and consequently the foul smell of acetone or other organic solvent will not spread.

Furthermore, the fingertip remains in close contact with an elastic bag-like material, such as one made of thin rubber, while nail finish is removed, which means that the fingertip is not covered by any bulky member and thus the fingers can be moved freely to pick up things or perform other tasks.

DESCRIPTION OF THE SYMBOLS

1 - - - Nail care tool
2 - - - Liquid-absorbing member
3 - - - Roll-up part
4 - - - Fingertip contact area
5 - - - Film

DETAILED DESCRIPTION OF THE PREFERRED EMBODIMENT

The nail care or finger care tool proposed by the present invention is a finger-cot-like elastic bag-like material made of rubber, etc., which has a liquid-absorbing member made of cotton, etc., attached over the part of the inside of the bag-like material that comes in contact with the nail when the tool is placed on the finger and, because of this structure, the bag-like material in a rolled-up condition can be rolled back toward the base of the finger to be placed on the finger with ease, for example. Also, the aforementioned liquid-absorbing member made of cotton, etc., can be directly bonded with a part of the inside of the bag-like material to make them one piece, or the two can be integrated via a film made of aluminum foil, PET, polyethylene, etc.

Care performed using this nail care tool is one where nail polish remover, cuticle oil or other moisturizing solution is applied to the nail to remove manicure or soft gel, while care performed using this finger care tool is one where oil, cream or other finger care treatment agent is applied on the finger surface to resolve the problems of rough nails or rough fingers caused by various reasons.

Figure 10:
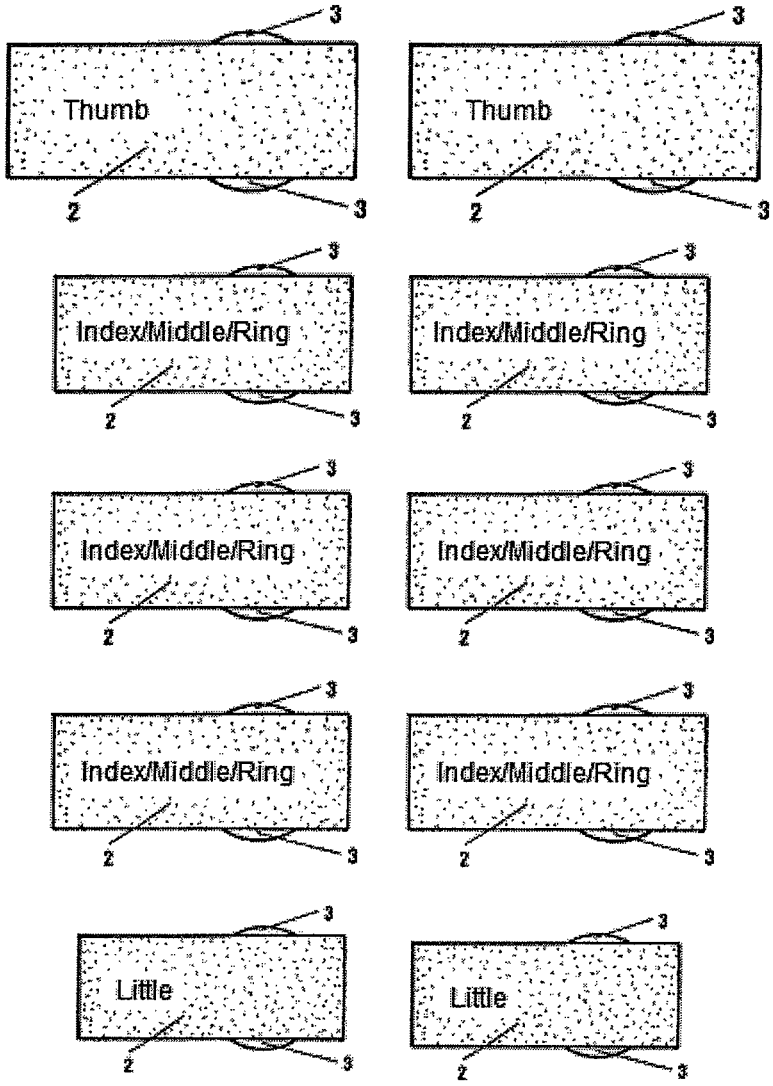
FIG. 10 illustrates a rear view of a set of nail care tools conforming to the present invention.

Normally the fingers of the hand have the largest nail on the thumb and smallest one on the little finger, while the nails of the index finger, middle finger and ring finger are roughly of the same size. Also when a nail care tool conforming to the present invention is used, the liquid-absorbing member remains in close contact with the entire surface of nail. In addition, it is desirable to keep nail polish remover from contacting areas of skin other than the nail as much as possible. In consideration of the above, it is desirable that the size of the liquid-absorbing member of each nail care tool conforming to the present invention be adjusted, as much as possible, to reflect the actual nail size of the applicable finger. For this reason, it is possible to provide a set of tools combining two tools for thumbs, two tools for little fingers, and six tools for index, middle and ring fingers as illustrated in FIG. 10 (the numerals denote the same elements as in FIG. 2).

If this tool is used for finger care, not just on the nail, however, different finger sizes need not be considered as much as they should in the case of nail care.

If a nail care or finger care tool conforming to the present invention is used for finger care, it is necessary that the liquid-absorbing member be large enough to wrap around each finger, including the nail, in its entirety and that the bag-like material is long enough to cover the finger sufficiently.

The present invention is explained below using the drawings by giving an example of its use as a nail care tool.

Figure 1:
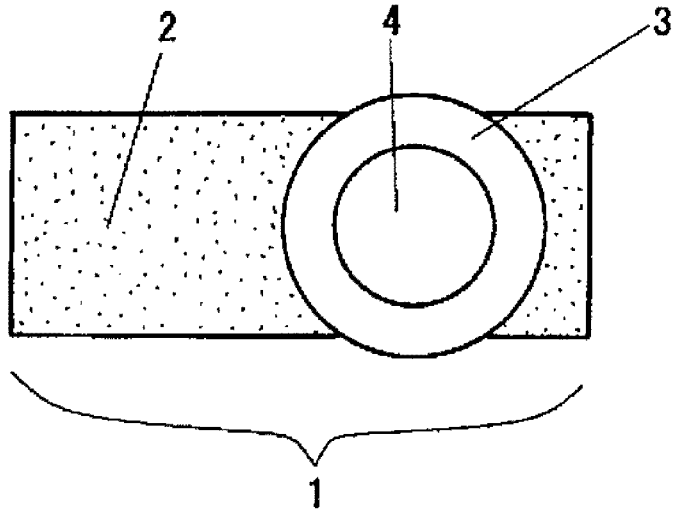
FIG. 1 is a front view of a nail care tool conforming to the present invention.

FIG. 1 is a nail care tool 1 comprised of an elastic bag-like material of sufficient size to cover the nail at the fingertip, where the bag-like material is rolled up to form a roll-up part 3, while a liquid-absorbing member 2 is attached over the fingertip contact area 4 of the bag-like material.

The elastic bag-like material can be formed by rubber or other material normally used for so-called finger cots. Natural rubber can be adopted, but urethane rubber, isoprene rubber, polybutadiene rubber, acrylonitrile-butadiene rubber, styrene-butadiene rubber, silicon rubber or any other synthetic rubber may be used for users allergic to natural rubber.

By using such a bag-like material, elastic and contraction forces of rubber or other elastic material constituting the bag-like material will keep the inside of the rubber bag-like material to remain in close contact with the fingertip while the fingertip is covered with the bag-like material.

In addition, this bag-like material made of rubber or other elastic material must not let acetone or other liquids permeate through it, nor soften, dissolve or degrade in any way when it comes in contact with liquids.

The shape of the elastic bag-like material used in the nail care tool proposed by the present invention can have a shape similar to that of a finger cot. In addition, the nail care tool proposed by the present invention need not cover the finger all the way to its base, as it is sufficient to cover only the nail. Accordingly, it can have a shape shorter than a finger cot, such as one just enough to cover up to the first joint or second joint.

Figure 2:
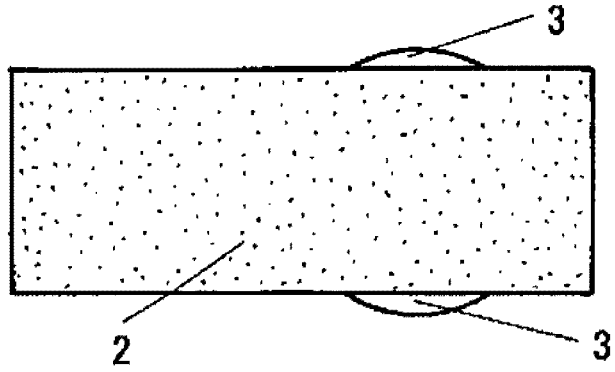
FIG. 2 is a rear view of a nail care tool conforming to the present invention.
Figure 3:
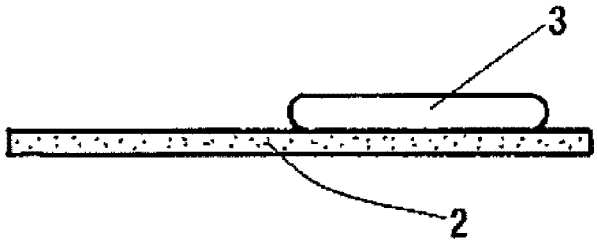
FIG. 3 is a side view of a nail care tool conforming to the present invention.

In FIGS. 1 to 3, the liquid-absorbing member 2 is attached to the fingertip contact area 4 of the rolled-up nail care tool 1, but this liquid-absorbing member 2 is shown slightly larger than it actually is. Rather than the size, it is necessary that when the nail care tool 1 is placed on the finger, the shape of the liquid-absorbing member 2 is such that it properly comes in close contact with the entire surface of nail, while minimizing other areas of the finger, other than the nail, to be contacted. The liquid-absorbing member 2 shown in FIGS. 1 to 3 can be slightly reduced in size, even when various factors are taken into consideration, such as that the sizes of nails vary from one person to another and that the liquid-absorbing member 2 may slightly shift relative to the nail when the fingernail is covered by the nail care tool.

For the liquid-absorbing member 2, any material traditionally used for cosmetic wipes, nail polish removers, etc., can be selected and used, such as cotton, felt or other fibrous thick sheet, or sponge sheet or other porous material.

Also note that the roll-up part 3 is a rolled part formed by rolling up the nail care tool 1, whose shape is roughly the same as that of a donut and which has a fingertip contact area 4 that comes in contact with the fingertip while the tool is in use.

The roll-up part 3 may be a thick part forming the end of the nail care tool 1, just like the corresponding part of any traditional finger cot, or it can have the same thickness as that of other areas of the nail care tool. However, it is necessary that while the nail care tool is placed over the fingertip, the roll-up part remains in close contact with the finger in an airtight manner so as to prevent volatilized nail polish remover from diffusing into the room.

Figure 7:
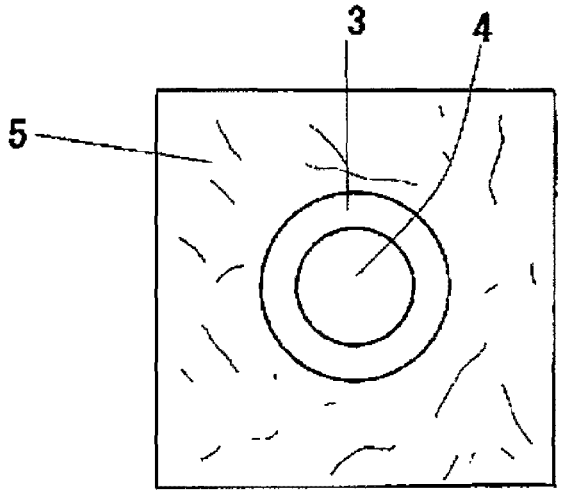
FIG. 7 is a front view of a nail care tool conforming to the present invention having aluminum foil.
Figure 8:
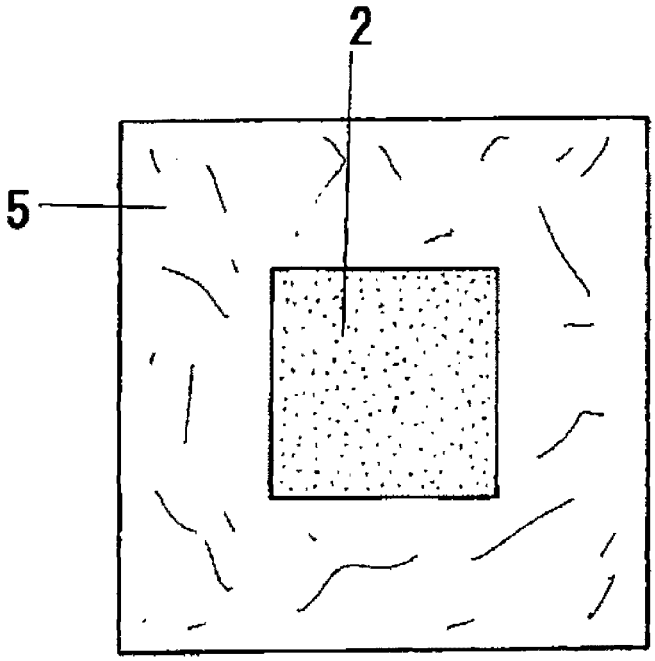
FIG. 8 is a rear view of a nail care tool conforming to the present invention having aluminum foil.

Also, as shown in FIG. 7, a film 5 such as aluminum foil or resin film made of PET, polyethylene, etc., may be provided between the roll-up part 3 and liquid-absorbing member 2 of the nail care tool shown in FIG. 1. FIG. 7 is a front view of the nail care tool as seen from the roll-up part, so the liquid-absorbing member 2 is not directly visible. In the rear view shown in FIG. 8, however, the liquid-absorbing member 2 is seen attached to the film 5. As shown, this film 5 is sufficiently larger than the liquid-absorbing member 2. Note that in FIGS. 7 to 9, lines on this film indicate wrinkles.

How this film 5 should be provided between the liquid-absorbing member 2 and roll-up part 3 is not at all limited, but examples include bonding the film 5 to the liquid-absorbing member 2 and roll-up part 3, or bonding the film 5 to the liquid-absorbing member 2 first and then bonding the film/liquid-absorbing member assembly to the roll-up part.

This way, the film 5 can prevent direct contact between acetone, cream or other liquid absorbed by the liquid-absorbing member 2, and the elastic bag-like material, while the tool is in use. Because of this, the elastic bag-like material will not be degraded by acetone, cream, or other liquid.

Also when acetone, cream, or other liquid is impregnated into the liquid-absorbing member 2, one example of doing so is to place the nail care tool on the palm with the liquid-absorbing member 2 at the top, and then cause acetone, cream, or other liquid to be impregnated into the liquid-absorbing member 2. This way, acetone, cream, or other liquid may spread but will remain on the film 5. As a result, acetone, cream, or other liquid may not inadvertently attach to, cause irritation, and dirty the palm or fingertip or other skin surface.

Next, a mode of using the nail care tool 1 conforming to the present invention is explained by giving an example of its use for removal of soft gel.

Figure 4:
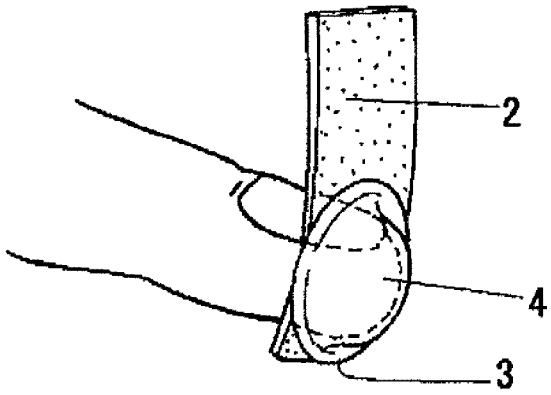
FIG. 4 shows a condition where a nail care tool conforming to the present invention is initially placed on the finger tip.

FIG. 4 shows the nail care tool 1 whose liquid-absorbing member 2 has been caused to absorb and support acetone or other nail polish remover beforehand, where the hand different from the one to which the nail care tool 1 is applied is holding the nail care tool 1 (not illustrated) and the fingertip contact area 4 of the nail care tool 1 conforming to the present invention is contacting the fingertip of the other hand.

Here, the liquid-absorbing member 2 must be positioned in such a way that the surface of a nail will be covered when the nail care tool 1 is rolled back. Needless to say, soft gel, etc., on the surface of the nail cannot be sufficiently removed if the position of the liquid-absorbing member 2 is completely incorrect and it does not contact the nail.

It is also necessary that the roll-up part 3 exist around the fingertip.

Figure 5:
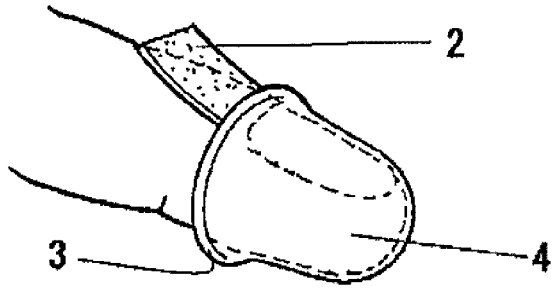
FIG. 5 shows a condition where a nail care tool conforming to the present invention is being placed on the finger tip.

Next, the roll-up part 3 of the nail care tool 1 is gradually unrolled toward the base to cover the finger with the nail care tool 1, as shown in FIG. 5. At this time, the liquid-absorbing member 2 must closely contact the entire surface of the nail.

Figure 6:
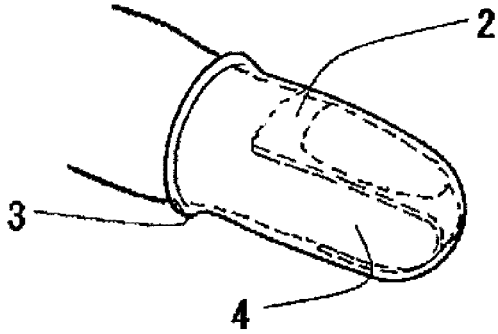
FIG. 6 shows a condition where a nail care tool conforming to the present invention has been placed on the finger tip.

When the roll-up part of the nail care tool 1 is unrolled continuously this way, the fingertip is covered by the nail care tool 1 in a manner covering the nail, as shown in FIG. 6. Since this nail care tool 1 is made of rubber or other elastic material, as mentioned above, it exerts an appropriate pressure to compress the entire fingertip, while pressing the liquid-absorbing member 2 against the surface of the nail.

Thus covering the fingertip, the nail care tool 1 dissolves and softens the soft gel, etc., on the surface of the nail for several minutes to as long as 10 to 15 minutes.

Since a minimum amount of nail polish remover comes in contact with the skin other than the nail, natural oil will not be stripped from the skin due to nail polish remover to whiten or roughen skin.

There is only the unrolled nail care tool 1 on the fingertip during this entire time, without any member that restricts the movement of the fingertip. Accordingly, the nail care tool 1 can be installed on all fingers at the same time according to the same process to remove nail finish from all fingers simultaneously, and even while doing this, items can be picked up or other tasks using the fingers can be performed.

Also, nail polish remover containing acetone, etc., remains inside the nail care tool 1 installed on the fingertip, and because the roll-up part 3 of the nail care tool 1 remains in close contact with the finger, nail polish remover does not contact outside air. As a result, the foul smell of acetone or other organic solvent will not fill the room and a favorable indoor environment will be maintained, thus preventing people in the room from feeling sick.

Once the specified time has elapsed and soft gel, etc., on the surface of nail has become sufficiently soft, the nail care tool 1 is removed from the fingertip by rolling up the roll-up part 3 in the opposite way to when the tool was installed on the finger, and thrown away. When the remaining soft gel, etc., on the surface of nail is wiped off with cotton, etc., the entire process is complete.

Figure 9:
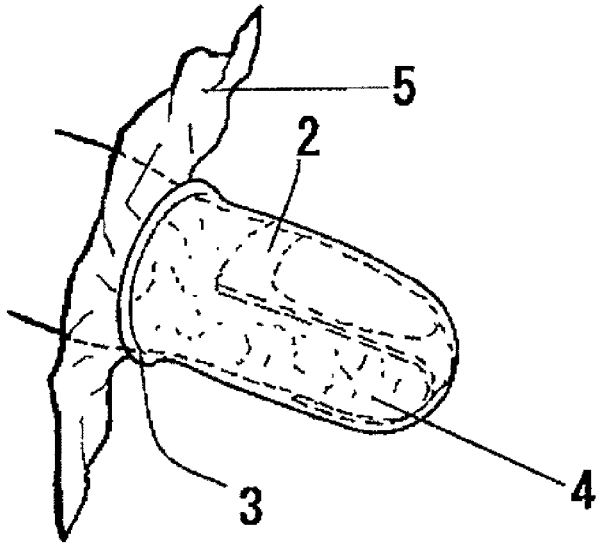
FIG. 9 shows a condition where a nail care tool conforming to the present invention having aluminum foil has been placed on the finger tip.

Furthermore, a nail care tool with a film 5, also conforming to the present invention, allows the film 5 to cover the area from the fingertip contact area 4 to the unrolled roll-up part 3 and even to the area further outside, as shown in FIG. 9. If the nail care tool adopts this structure, it can be removed by holding the roll-up part 3 from the finger after use, or it may be easier to remove the tool by holding the film 5.

The above example applies to removal of soft gel, but the present invention is not at all limited to this example and it can be used to care for nails using nail care oil or cream, or to care for fingers including nails by applying finger care oil or cream. When doing this, the liquid-absorbing member 2 must be large enough to cover the finger, not to mention large enough to cover the nail, as shown in each figure. If a film 5 is used in these applications, this film 5 must be larger than the liquid-absorbing member 2.

The present application claims priority to Japanese Patent Application No. 2010-117976, filed May 24, 2010, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A nail care or fingertip care tool comprised of an elastic bag-like material having sufficient size to cover the nail at the fingertip and also having a liquid-absorbing member fixedly attached over an area on an inner side of the bag-like material for coming in contact with the nail, wherein the bag-like material is in a rolled-up condition and has a fingertip contact area and a rolled-up part therearound, and the liquid-absorbing member has a sheet-like shape, extends beyond the rolled-up part, and is fixedly attached over the area on the inner side of the bag-like material that spreads out when the bag, like material is unrolled, so that the portion of the liquid-absorbing member fixedly attached over the area of the bag-like material and a portion of the liquid-absorbing member extending beyond the rolled-up part are inside the bag-like material and come in contact with the nail when the rolled-up part is unrolled.

2. A nail care or fingertip care tool according to claim 1, wherein the liquid-absorbing member is fixedly attached to the elastic bag-like material via a film.

3. A nail care or finger care tool according to claim 2, which has a section indicating the name of the nail on which the tool is placed and/or position where the tool is placed.

4. A nail care or finger care tool according to claim 2, wherein the elastic bag-like material is made of rubber.

5. A nail care or finger care set combining a multiple number of nail care or finger care tools according to claim 2, wherein the tools, including the liquid-absorbing members, have different sizes to match the nail sizes of different fingers.

6. A nail care or finger care tool according to claim 1, which has a section indicating the name of the nail on which the tool is placed and/or position where the tool is placed.

7. A nail care or finger care set combining a multiple number of nail care or finger care tools according to claim 6, wherein the tools, including the liquid-absorbing members, have different sizes to match the nail sizes of different fingers.

8. A nail care or finger care tool according to claim 2, wherein the elastic bag-like material is made of rubber.

9. A nail care or finger care set combining a multiple number of nail care or finger care tools according to claim 1, wherein the tools, including the liquid-absorbing members, have different sizes to match the nail sizes of different fingers.

* * * * *